United States Patent [19]

Beyer

[11] Patent Number: 4,969,448

[45] Date of Patent: Nov. 13, 1990

[54] BOW STRING RELEASE

[76] Inventor: Mark D. Beyer, E2418 Silver Lake Rd., Scandinavia, Wis. 54977

[21] Appl. No.: 304,248

[22] Filed: Jan. 31, 1989

[51] Int. Cl.[5] ..... F41B 5/00

[52] U.S. Cl. ..... 124/35.2; 124/35.1

[58] Field of Search ..... 124/23 R, 24 R, 25, 124/31, 35 R, 35 A

[56] References Cited

U.S. PATENT DOCUMENTS

| | | | |
|---|---|---|---|
| 3,898,974 | 8/1974 | Keck | 124/35 A |
| 3,954,095 | 5/1976 | Lewis | 124/35 A |
| 4,009,703 | 3/1977 | Cunningham | 124/35 A |
| 4,232,649 | 11/1980 | Allen et al. | 124/35 A |
| 4,308,851 | 1/1982 | Kaine et al. | 124/35 A |
| 4,316,443 | 2/1982 | Giacomo | 124/35 A |
| 4,498,448 | 2/1985 | Fletcher | 124/35 A |
| 4,509,497 | 4/1985 | Garvison | 124/35 A |
| 4,539,968 | 9/1985 | Garvison | 124/35 A |
| 4,672,945 | 6/1987 | Carlton | 124/35 A |
| 4,791,908 | 12/1988 | Pellis | 124/35 A |
| 4,831,997 | 5/1989 | Greene | 124/35 A |

*Primary Examiner*—Randolph A. Reese

*Assistant Examiner*—John A. Ricci

*Attorney, Agent, or Firm*—Fleit, Jacobson, Cohn, Price, Holman & Stern

[57] ABSTRACT

A pistol grip-type of bow string release is provided including nose and heel ends and adapted to be encircled intermediate the ends by an archer's hand. The nose end includes a notch opening endwise outwardly thereof for receiving a bow string therein and the notch opens outward in a direction which substantially coincides with the longitudinal center axis of the associated archer's forearm when the archer's hand is inclined outwardly generally 30° relative to forearm. A bow string retaining and release structure is mounted within the notch for selectively retaining and releasing an associated bow string and an inward and outward shiftable plunger is operatively associated with the bow string retaining and release structure for retaining the retaining and release structure in an active position when the plunger is inwardly shifted and releasing the bow string retaining and release structure for movement to an inactive position thereof upon outward shifting of the plunger.

6 Claims, 1 Drawing Sheet

BOW STRING RELEASE

BACKGROUND OF THE INVENTION

1. Field of the Invention

This invention relates to a bow string holding and release mechanism incorporating a depressable plunger operable to retain a bow string when depressed and to release a bow string when the plunger is released. In addition, the bow string release mechanism further incorporates an adjustable length wrist cinch from which the release mechanism is tethered through the utilization of a flexible loop and the release mechanism includes a flat pistol grip-type of body to be substantially encircled by the fingers of an archer's hand and is equipped with a nose end from which the associated bow string is released in a direction extending outward from the nose end of the body. Further, the nose end of the body and the cinch coact in a manner such that the direction in which an associated bow string is released parallels the forearm of the user of the release mechanism when the user's hand is inclined outwardly (relative to his forearm) approximately 45°. The cinch is constructed in a manner such that it is tightened about the user's wrist, when his hand is in the aforementioned inclined position, to define a substantial stop for movement of the wrist to the inclined position thereof.

2. Description of Related Art

Various different forms of bow string releases heretofore have been provided including some of the general structural and operational features of the instant invention. Examples of these previously known bow string releases are disclosed in U.S. Pat. Nos. 3,898,974, 3,954,095, 4,009,703, 4,232,649, 4,316,443, 4,498,448, 4,509,497 and 4,672,945. However, these previously known bow string release mechanisms do not include the overall structural and operational features of applicant's invention.

SUMMARY OF THE INVENTION

The bow string release of the instant invention is designed, primarily, to allow the release of a drawn bow string by an archer with a minimum amount of "flinching" by the archer. By reducing the amount of "flinching" when the bow string is released, greater accuracy is repeatedly attained by the archer.

The bow string release also is designed to enable the hand of the archer holding the release to contact and abut the corresponding side of the cheek of the archer to thereby enable the neck muscles of the archer to be used in conjunction with the hand and arm muscles of the archer to maintain an associated drawn bow string steady relative to the corresponding bow.

Still further, the bow string release is constructed in a manner such that the wrist of an associated archer may be braced relative to the forearm of the archer and with the movement of the associated bow string from a fully drawn position toward the corresponding bow in a direction substantially coinciding with the longitudinal center axis of the forearm of the associated archer.

Also, the bow string release is constructed to incorporate a thin pistol grip-type of handgrip as well as a substantially silent release mechanism.

The main object of this invention is to provide a bow string release which may be used by an archer to fully draw and then release an associated bow string with a minimum amount of "flinching" on the part of the archer.

Another object of this invention is to provide a bow string release constructed in a manner enabling the neck muscles of an associated archer to be used in conjunction with the archer's hand and arm muscles to maintain a bow string in a fully drawn condition stationary relative to the associated bow until the time of release of the bow string.

A still further object of this invention is to provide a bow string release which will be comfortable to grip and hold during the process of drawing a bow string and maintaining the bow string in a fully drawn position until the bow string is released.

Another object of this invention is to provide a bow string release constructed in a manner to facilitate angulation of an archer's wrist relative to his forearm to an effective limit position of angulation with the direction of movement of an associated bow string from the release substantially coinciding with the longitudinal center axis of the forearm of an archer.

Yet another object of this invention is to provide a bow string release which will be substantially silent during a bow string releasing operation.

A further object of this invention is to provide a bow string release which may be used effectively by right and left handed archers.

A final object of this invention to be specifically enumerated herein is to provide a bow string release in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
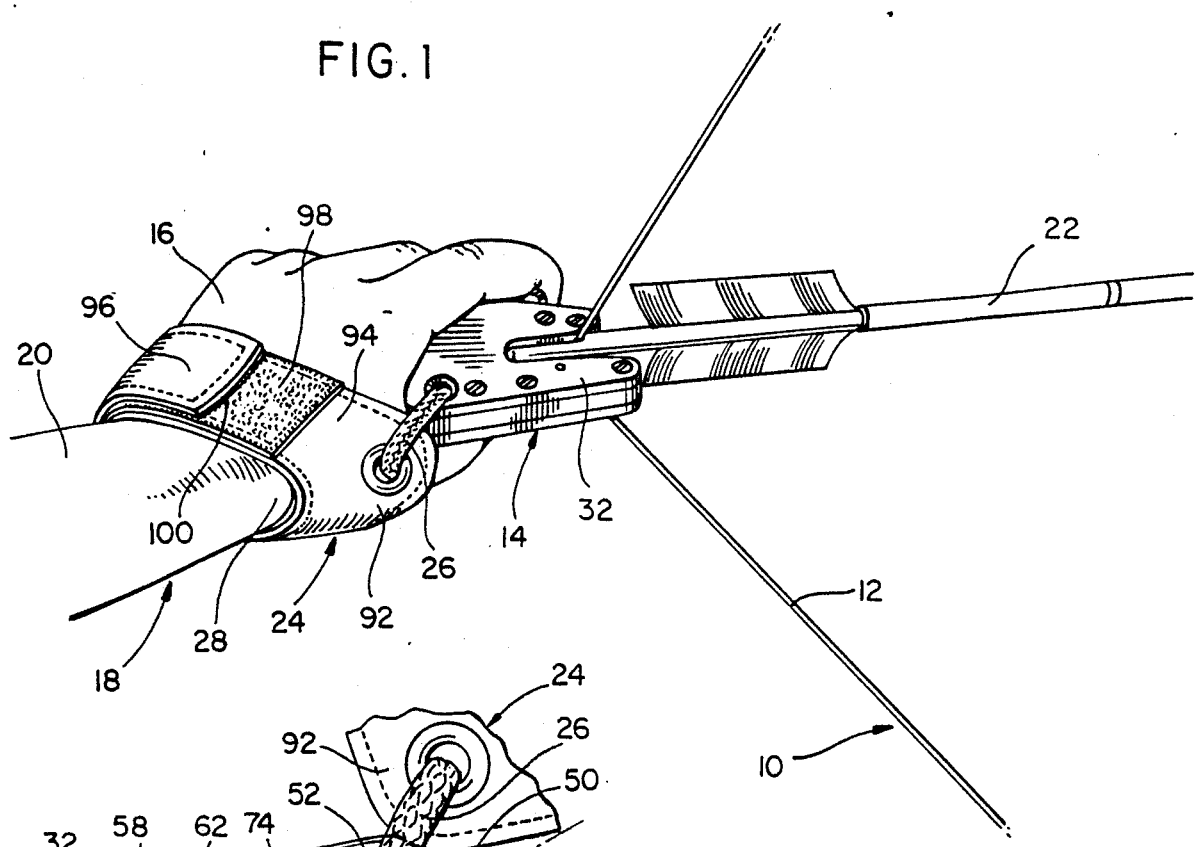
FIG. 1 is a perspective view of the bow string release of the instant invention in use by a left handed archer and with an associated bow string in a fully drawn position, the hand of the archer being inclined generally 30° relative to the longitudinal axis of the archer's forearm and with the bow string release anchored relative to the wrist of the archer through the utilization of an adjustable length cinch.

Referring now more specifically to the drawings, the numeral 10 generally designates an archery bow including a bow string 12 and a bow string release constructed in accordance with the present invention is referred to in general by the reference numeral 14.

The bow string release 14 is illustrated in FIG. 1 as being gripped by the left hand 16 of an archer referred to in general by the reference numeral 18 and it may be seen from FIG. 1 that the hand 16 is inclined to the outer side of the forearm 20 of the archer 18 at approximately 30°.

An arrow 22 is nocked with the bow string 12 and the bow string release 14 has an adjustable length cinch referred to in general by the reference numeral 24 secured thereto through the utilization of a flexible loop 26, the cinch 24 being adjustable in length and secured about the left wrist 28 of the archer 18.

Figure 2:
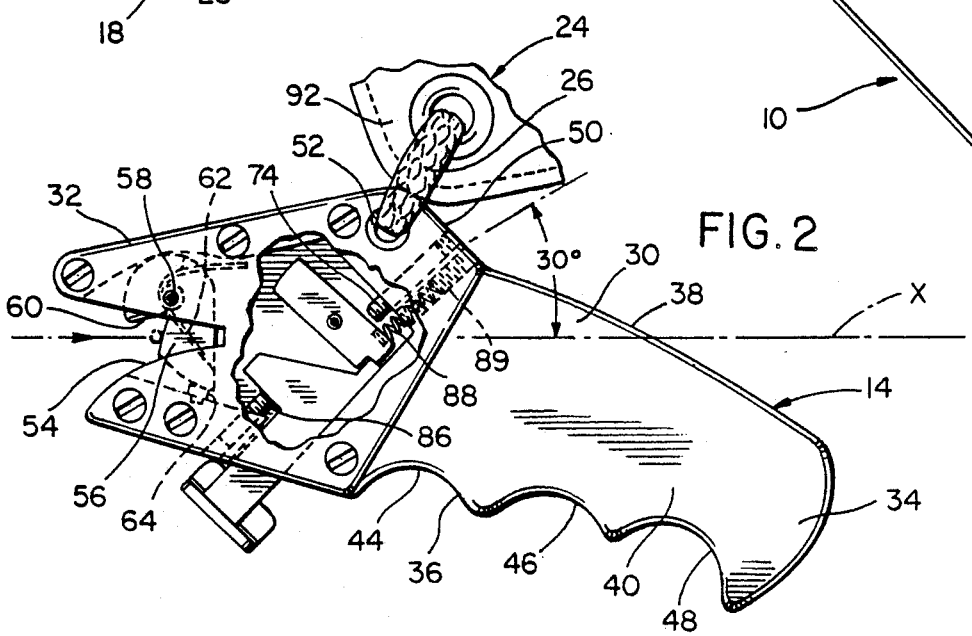
FIG. 2 is an enlarged top plan view of the bow string release illustrated in FIG. 1 with portions of the central near side walls thereof broken away to illustrate internal structural components of the release in their relative positions immediately prior to engagement of the release with an associated bow string.

With attention now invited more specifically to FIG. 2 of the drawings, it may be seen that the bow string release 14 incorporates an elongated body 30 adapted to be encircled and gripped by either the right or left hand of the archer 18. The body includes a forward nose end 32 and a rearward heel end 34 between which front and rear narrow longitudinal side edges 36 and 38 extend. In addition, opposite side surfaces 40 and 42 of the body 30 extend between the edges 38 and 40 and the ends 32 and 34.

The front edge 36 includes longitudinally spaced notches 44, 46 and 48 formed therein for receiving the second finger joints of the second, third and little fingers therein and the rear edge 38 is adapted to extend across the mid-portion of the palm of the hand 16. The rear edge 38 includes a projection 50 spaced from the nose end 32 toward the heel end 34 and which is inclined outwardly toward the nose end 32 and provided with a transverse aperture 52 therethrough. In addition, the nose end 32 of the body 30 defines a notch 54 therein opening endwise outwardly of the nose end 32 and through the opposite side surfaces 40 and 42.

Figure 3:
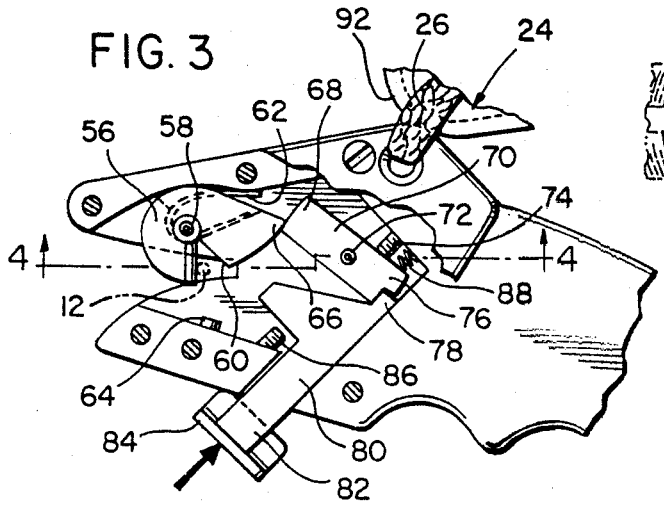
FIG. 3 is a fragmentary plan view of the bow string release with portions of the near side wall broken away and illustrating the internal components in their relative positions when a bow string is retained in a fully drawn position by the release.

The interior of the nose end 32 of the body 30 is hollow and pivotally mounts a cam member 56 therein as at 58 and the cam member 56 includes a second notch 60 formed therein opening transverse to the notch 54 when in the bow string retaining position thereof illustrated in FIG. 3 and opening outwardly of the notch 54 when in the bow string release and receiving position thereof illustrated in FIG. 2, the cam member 56 being spring biased toward the bow string release and receiving position illustrated in FIG. 2 by a butterfly spring 62.

The bow string release and receiving position of the cam member 56 is established by a resilient bumper 64 mounted within the hollow interior of the nose end 32 and the cam member 56 includes a toe portion 66 engageable by a first end 68 of an elongated lever 70 pivotally mounted in the hollow interior of the nose end 32 as at 72 when the lever 70 is in the active position thereof illustrated in FIG. 3 established by an adjustable stop screw 74. The second end 76 of the lever 70 is notched and engaged by the inner end 78 of an elongated actuator or plunger 80 rectilinearly reciprocally mounted from the nose end 32. When the plunger 80 is in the inner limit position thereof illustrated in FIG. 3, it engages the second end 76 of the lever 70 to retain the lever in the limit position thereof defined by the adjustable screw 74 for retaining the cam member 56 in the bow string retaining position thereof. The outer end 82 of the plunger 80 includes a finger engageable member 84 supported therefrom to be engaged by the forefinger of the hand 16 immediately outward of the second joint of the forefinger.

Figure 4:
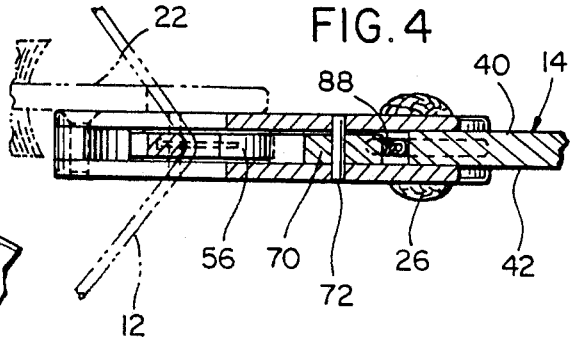
FIG. 4 is a fragmentary vertical sectional view taken substantially upon a plane indicated by the section line 4—4 of FIG. 3.

When the plunger 80 is in the innermost limit position thereof illustrated in FIG. 3, it is in a first active position thereof, and when the plunger 80 is in the outer limit position thereof defined by a second adjustable stop screw 86 it is in the second inactive position thereof. When the plunger 80 moves from the first active position thereof illustrated in FIG. 3 toward the second inactive position thereof, the lever 70 is allowed to pivot in a clockwise direction as illustrated in FIG. 3 under the biasing action of a compression spring acting on the second end 76 thereof and the portion 66 of the cam member 56 is thereby released for pivoting movement of the cam member 56 from the bow string retaining position thereof illustrated in FIG. 3 to the bow string release position illustrated in FIG. 2, the tension of the bow string 12 also serving to rapidly pivot the cam member 56 from the position thereof illustrated in FIG. 3 to the position thereof illustrated in FIG. 4 upon clockwise pivoting of the lever 70 from the position illustrated in FIG. 2 to the position illustrated in FIG. 3.

It thus may be noted that the plunger must be held in the first active position thereof illustrated in FIG. 3 to maintain the cam member 56 in the bow string retaining position thereof illustrated in FIG. 3 and that in order to release the bow string 12 relative to the bow string release 14 the plunger 80 must be allowed to shift outward relative to the body 30 toward the second inactive position of the plunger 80.

The sensitivity of the release of the bow string 12 by the release 14 can be adjusted by adjustment of screw 74, which determines the contact overlap lever 70 has with the toe portion 66 of the cam member 56, and/or by adjustment of the follower screw 89 of spring 88, which adjusts the amount of tension on lever 70. The ability to adjust the sensitivity of the release of the bow string will be beneficial for uses (hunting versus target shooting) or by users (male versus female shooters).

Inasmuch as finger pressure from the forefinger of the hand 18 is released in order to release the bow string 12 and not applied to the plunger 80, considerably less "flinching" of the archer 18 occurs during release of the bow string 12. This increases the accuracy of the archer 18 as well as renders the accuracy of the archer 18 more consistent.

When the body 30 is held in the hand 16, the projection 50 is seated in the crotch of the hand defined between the forefinger and thumb. Further, the cinch 24 is constructed of flexible material and is substantially right angular in plan shape including a corner apex portion 92 and a pair of divergent legs 94 and 96. Opposite side surfaces of the legs 94 and 96 have coacting thistle-type fastener pile and loop strips 98 and 100 secured thereto and the free ends of the legs 94 and 96 are lap engaged with each other with the strips 98 and 100 releasably anchored with each other. The legs 94 and 96 are tightly secured about the wrist 28 and, after this has been accomplished and the body 30 is gripped by the hand 16, the hand 16 is inclined forwardly and outwardly approximately 30° relative to the longitudinal center line of the forearm 20 as the bow string release 14 is being used to draw the bow string 12. This results in the notch 54 opening outwardly in a direction which substantially corresponds to the longitudinal center axis of the forearm 20 and, of course, the longitudinal center line of the arrow 22, resting upon the upper side surface 40, substantially coincides with the longitudinal center axis of the forearm 20. Also, because of the reasonably tight cinch 24 and the fact that the loop 26 anchors the bow string release 14 to the apex portion 92 of the cinch 24, angling the hand 16 forward and outward relative to the forearm 20 at approximately 30° relative thereto tightens the cinch 24 relative to the wrist 28, whereby the cinch 24 defines a reasonable limit of angulation of the hand 16 relative to the forearm 20 of substantially 30°.

Accordingly, not only is the bow string release 14 wedged tighter into the palm of the hand 16, but the hand 16 is braced in angulated position relative to the forearm 20. In addition, the arrow 22 substantially coincides with the longitudinal center axis of the forearm 20 and, because of the 30° outward inclination of the hand 16 relative to the forearm 20, the apex portion 92 of the cinch 24 may be reasonably tightly engaged with the side of the face of the archer 18 to further steady the drawn bow string 12 and facilitate support of the bow and drawn bow string as well as the arrow 32 in stationary position relative to the head of the archer 18. This, of course, greatly facilitates shooting accuracy as well as consistency of accuracy.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A bow string release including a thin, elongated piston grip-type of body including a forward nose end and a rearward heel end and adapted to be gripped by either the right or left hand of an anchor, said body also defining narrow front and rear longitudinal edges extending between said ends, said rear edge including an outward projection spaced from said nose end toward said heel end and inclined outward toward said nose end, said body being adapted to be gripped and generally encircled by said hand with the second, third and fourth fingers of said hand substantially encircling said body and the second joints of said fingers spaced along said front edge, said rear edge extending laterally across the mid-palm area of said hand and the juncture between the thumb and first finger of said hand abutted against said projection with the thumb and first finger of said hand generally paralleling each other over opposite side surfaces of said body extending between said ends and edges, said nose end defining an endwise outwardly opening notch therein opening through said side surfaces, bow string retaining means in the inner portion of said notch and mounted from said body for movement between applied and release position with said retaining means in bow string release and bow string retaining positions, respectively, an actuator shiftably mounted from said body for movement between first and second positions, means operatively associating said actuator with said retaining means for retaining said retaining means in said applied position when said actuator is in said first position and releasing said retaining means for movement to said release position when said actuator is in said second position, said actuator projecting outward of said front edge for engagement by said first finger, said actuator comprising an elongated plunger disposed generally in the medial plane of said body and having a first end projecting outward of said front edge, said plunger being mounted from said body for lengthwise reciprocation relative to said body, said first and second positions of said plunger comprising longitudinally shifted positions of said plunger, said second position comprising an outward shifted position of said plunger relative to said body and said first position comprising an inward shifted position of said plunger relative to said body, an outer portion of said projection having a small tether loop anchored relative thereto, a generally L-shaped flexible strap member including an apex portion and a pair of divergent legs, said tether loop being anchored to said apex portion, said legs being adapted to extend in opposite directions about the wrist from which said hand is supported and including overlapping engageable free ends remote from said apex portion equipped with releasably engageable hook and loop pile thistle-type fastening means.

2. The release of claim 1 wherein said notch opens in a direction inclined generally 3020 relative to the knuckle line of a hand grasping said body, whereby when said hand is inclined outward approximately 30° relative to the associated forearm said notch will open outward in a direction substantially coinciding with the longitudinal center line of said forearm.

3. A bow string release comprising an elongated body having a forward nose end and a rearward heel end and an outer contour to be grasped and encircled by one hand of an archer with the thumb and first finger of said hand generally paralleling each other over opposite side surfaces of said body extending between said ends and edges, said nose end defining an endwise outwardly opening first notch therein opening through said side surfaces, a cam member pivotally mounted from said body and projecting into said first notch between said side surfaces, said cam member defining a second notch therein and being pivotable between a bow string retaining position and a bow string release and receiving position with said second notch opening transversely of and outwardly of, respectively, said first notch, an elongated lever pivotally mounted in said body for movement between active and inactive positions, said lever and cam including coacting means operative to retain said cam in said bow string retaining position when said lever is in said active position and to release said cam for movement to the bow string release position thereof when said lever is shifted from said active position toward said inactive position, and an actuator shiftably supported from said body for movement between first and second positions and coacting with said lever to maintain the latter in said active position when said actuator is in said first position and to release said lever for movement to the inactive position upon movement of said actuator toward said second position, said rear edge including an outward projection spaced from said nose end toward said heel end and inclined outward toward said nose end for abutting engagement by the juncture between the thumb and first finger of said hand thereagainst, an outer portion of said projection including a small tether loop anchored relative thereto, a generally L-shaped flexible strap member including an apex portion and a pair of divergent legs, said tether loop being anchored to said apex portion, said legs being adapted to extend in opposite directions about the wrist from which said hand is supported and including overlappingly engageable free ends remote from said apex portion equipped with releasably engageable hook and loop pile thistle-type fastening means.

4. The release of claim 3 including means independently yieldingly biasing said cam toward said bow string release and receiving position and said lever toward said inactive position.

5. The release of claim 4 wherein said actuator includes an elongated plunger mounted from said body with one end thereof projecting outward of said front edge adjacent said nose end and said plunger is mounted for longitudinal reciprocation relative to said body between outward and inward positions with said one end of said plunger displaced, respectively, outward and inward relative to said front edge.

6. A bow string release comprising an elongated body having a forward nose end and a rearward heel end and an outer contour to be grasped and encircled by one hand of an archer with the thumb and first finger of said hand generally paralleling each other over opposite side surfaces of said body extending between said ends and edges, said nose end defining an endwise outwardly opening first notch therein opening through said side surfaces, a cam member pivotally mounted from said body and projecting into said first notch between said side surfaces, said cam member defining a second notch therein and being pivotable between a bow string retaining position and a bow string release and receiving position with said second notch opening transversely of and outwardly of, respectively, said first notch, an elongated lever pivotally mounted in said body for movement between active and inactive positions, said lever and cam including coacting means operative to retain said cam in said bow string retaining position when said lever is in said active position and to release said cam for movement to the bow string release position thereof when said lever is shifted from said active position toward said inactive position, and an actuator shiftably supported from said body for movement between first and second positions and coacting with said lever to maintain the latter in said active position when said actuator is in said first position and to release said lever for movement to the inactive position upon movement of said actuator toward said second position, means independently yieldingly biasing said cam toward said bow string release and receiving position and said lever toward said inactive position, said actuator including an elongated plunger mounted from said body with one end thereof projecting outward of said front edge adjacent said nose end and said plunger being mounted for longitudinal reciprocation relative to said body between outward and inward positions with said one end of said plunger displace, respectively, outward and inward relative to said front edge, said outward position of said plunger comprising said second position of said actuator.

* * * * *